United States Patent [19]

Flores

[11] 4,048,631

[45] Sept. 13, 1977

[54] PORTABLE VARIABLE INTENSITY SIGNALLING FLASHLIGHT

[76] Inventor: Jose Flores, 50 Division St., Apt. 7C, Brooklyn, N.Y. 11211

[21] Appl. No.: 649,259

[22] Filed: Jan. 15, 1976

[51] Int. Cl.[2] ..... F21L 7/00

[52] U.S. Cl. ..... 340/321; 200/252; 240/10.6 SD; 240/10.66

[58] Field of Search ..... 340/321, 332, 330, 90, 340/110, 81 F, 70; 240/6.4 CL, 6.4 R, 10.5, 10.66, 10.6, 10.6 SD; 200/252, 310, 239, 61.28; 315/313, 317

[56] References Cited

U.S. PATENT DOCUMENTS

| | | | |
|---|---|---|---|
| 1,822,619 | 9/1931 | Grossman | 240/10.6 SD |
| 2,498,805 | 2/1950 | Gurevsky | 315/317 |
| 2,751,490 | 6/1956 | Emerson | 340/321 |
| 3,030,497 | 4/1962 | Cheng | 340/321 |
| 3,197,757 | 7/1965 | Porta | 340/321 |
| 3,205,487 | 9/1965 | Vriend | 340/321 |
| 3,800,136 | 3/1974 | Edelson | 240/10.6 R |

*Primary Examiner*—John W. Caldwell
*Assistant Examiner*—James J. Groody
*Attorney, Agent, or Firm*—Robert D. Farkas

[57] ABSTRACT

This disclosure pertains to a manually operated hand held battery powered signalling flashlight adapted with two independently operable light sources, controlled by a common selector switch adapted to independently or concurrently energize each light source, and a dual acting variable resistor controlling the intensity of the light beams produced thereby. Each light source may project a different colored light beam.

1 Claim, 3 Drawing Figures

PORTABLE VARIABLE INTENSITY SIGNALLING FLASHLIGHT

BACKGROUND OF THE INVENTION

1. THE FIELD OF THE INVENTION

This invention relates to portable flashlights and more specifically to that class utilized to signal information as well as provide a source of general illumination.

2. DESCRIPTION OF THE PRIOR ART

The prior art abounds with a variety of signalling devices utilizing a maximum change light contrast as the means in which information is conveyed. The light source either projects a beam of defined intensity or no beam at all. International Morse code is most commonly signalled utilizing the above method.

SUMMARY OF THE INVENTION

The instant invention comprises a manually operable hand held battery powered dual flashlight which produces two beams of light that may be independently colored. A switch can energize either lamp selectively or both lamps concurrently as desired. A manually operated common ganged pair of variable resistors controls the intensity of light that each lamp may emit.

A primary object of the instant invention is to provide a signalling flashlight having dual light sources.

Another object is to provide two differently colored light beams.

Still another object is to provide a dual signalling flashlight which may have the amount of light emitted from each lamp manually varied.

A further object is to provide a switch that can energize selectively and concurrently each incandescent lamp.

Another object is to provide a signalling flashlight which can independently and concurrently illuminate to adjustable light levels similar or disimilar colored incandescent lamps providing thereby two parallel or diversly directed light beams emitting therefrom.

Still another object is to provide a signalling flashlight which creates an optical effect similar to rotating multiple incandescent lamps having different colored light emitting beams radiating radially outwardly therefrom by manual manipulation of its control switch and its intensity control knob.

Another object is to provide a signalling flashlight which can be utilized for general illumination purposes.

These objects, as well as other objects of this invention, will become readily apparent after reading the following description of the accompanying drawings.

DESCRIPTION OF THE PREFERRED EMBODIMENT

The structure and method of fabrication of the present invention is applicable to a signalling flashlight which is battery powered and has two incandescent light bulbs providing two sources of light each having a different color. The light bulbs may be located at one end of a longitudinal housing or, if desired, at alternate ends thereof. A slide switch is adapted to provide current supplied by the battery to each incandescent light bulb when positioned appropriately. An alternate position of the slide switch provides illumination from both incandescent lamps. A variable resistor is placed in series with each incandescent bulb and is adapted with a common knob. The resistor enables each lamp to be illuminated to the same degree, varying between maximum light intensity down to virtually no light emitting capabilities at all.

Operating the slide switch so as to alternately illuminate the two incandescent lamps in conjunction with the intensity of the light emitted therefrom, produces a great amount of intelligence that can be communicated by the operator to a distant viewer. Alternate lamp energization with intermediate manipulation of the common variable resistor interposed, can create the effect of the flashing lights commonly seen on emergency vehicles of the rotating or flashing variety. Light beams projecting in opposite directions which are colored red and green may be utilized to teach navigational and lookout observing techniques for aircraft and naval vessels. The device may also be utilized as a source of generally illumination of varied intensity by a simple setting of the variable resistor. Night vision may be enhanced by utilizing a red colored beam, and selectively at the times desired, a white colored beam for general illumination abroad naval vessels such as submarines and other craft.

Figure 1:
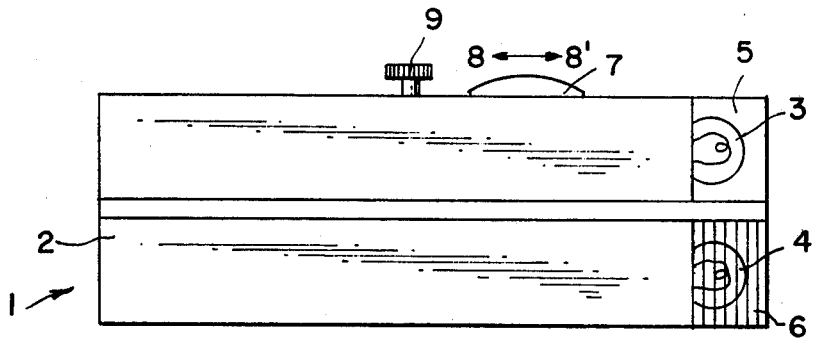
FIG. 1 is a side elevation view of a dual beam signalling flashlight.

Now referring to the Figures, and more particularly to the embodiment illustrated in FIG. 1 showing the dual signalling flashlight 1 adapted with a housing 2 containing a first incandescent lamp 3 and a second incandescent lamp 4. A transparent cover 5 encloses the opening in the housing 2 exposing lamp 3. A transparent cover 6 encloses the opening in the housing 2 exposing lamp 4. Each transparent cover may be fabricated from different colored plastic or glass materials so that two light beams are emitted, each having an individual color. The transparent covers may be interchanged with other colored covers providing thereby, an infinite variety of color combinations. An alternate embodiment of the signalling flashlight illustrated in FIG. 1 is signalling flashlight having each incandescent lamp at opposite ends of the housing. Such a desvice separates the distance between the light sources, thus enhancing the amount of information that may be conveyed therefrom. A side switch 7 can be manipulated in the directions of arrows 8 and 8' controlling the energization state of lamps 3 and 4. Rotating a knob 9 controls the amount of current supplied to the incandescent lamps 3 and 4 supplied by a battery, not shown, enclosed within the housing 2.

Figure 2:
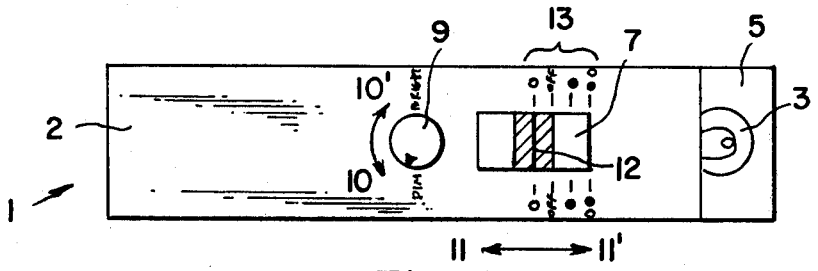
FIG. 2 is a plan view of a dual beam signalling flashlight.

FIG. 2 is a plan view of the signalling flashlight illustrated in FIG. 1 showing the housing 2 and the transparent cover 5 enclosing the incandescent lamp 3. Knob 9 may be rotated in the directions of arrows 10 and 10'. Slide switch knob 7 may be operated in the directions of arrows 11 and 11' positioning an indicating identification mark 12 thereon to a number of identifiable detented spaced markings 13, simultaneously changing the electrical interconnections within the housing and indicating to the user the mode of illumination of the incandescent lamps.

Figure 3:
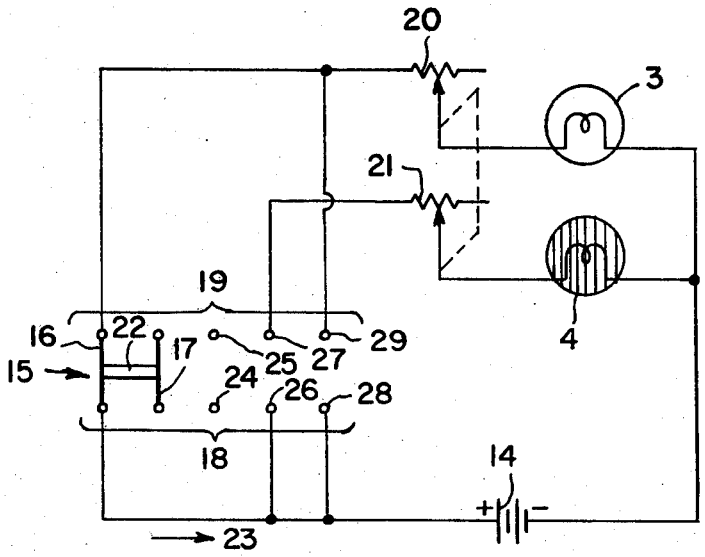
FIG. 3 is an electrical schematic of the electrical components comprising a dual beam signalling flashlight.

FIG. 3 illustrates the incandescent lamps 3 and 4 connected to the negative terminal of a battery 14. The positive terminal of the battery is connected to the battery side terminals 18 of a slide switch 15 having mechanically linked dual movable switch elements 16 and 17 therein. Load side terminals 19 connect to the dual legs 20 and 21 of a commonly adjustable dual variable resistor control.

When the linkage arm 22 locates movable switch elements 16 and 17 to the position illustrated in FIG. 3, incandescent lamp 3 is illuminated to a degree determined by the resistance in variable resistor leg 20. Lamp 4 is unilluminated.

When linkage arm 22 is moved in the direction of arrow 23 such that movable switch element 17 bridges battery side contact 24 and load side contact 25, neither incandescent lamps 3 nor 4 are illuminated.

Relocating movable switch element 17 to a position bridging battery side contact 26 and load side contact 27, provides a current flow to incandescent lamp 4 dependent upon the resistance inresistance leg 21. Lamp 3 is unilluminated.

Placing movable switch element 17 in contact with battery side contact 28 and load side contact 29 permits a current flow to exist through incandescent lamp 3 limited by the resistance setting of resistor leg 20, concurrent with another current flowing through incandescent lamp 4 limited by the resistance setting of resistor leg 21 and passing through load side contact 27, movable switch element 16, and battery side contact 26, to the positive terminal of battery 14.

One of the advantages is a signalling flashlight having dual light sources.

Another advantage is two differently colored light beams.

Still another advantage is a dual signalling flashlight which may have the amount of light emitted from each lamp manually varied.

A further advantage is a switch that can energize selectively and concurrently each incandescent lamp.

Another advantage is a signalling flashlight which can independently and concurrently illuminate to adjustable light levels similar to disimilar colored incandescent lamps providing thereby two parallel or diversely directed light beams emitting therefrom.

Still another advantage is a signalling flashlight which creates an optical effect similar to rotating multiple incandescent lamps having different colored light emitting beams radiating radially outwardly therefrom by manual manipulation of its control switch and its intensity control knob.

A further advantage is a signalling flashlight which can be utilized for general illumination purposes.

Thus, there is disclosed in the above description and in the drawings, embodiments of the invention which fully and effectively accomplish the objects thereof. However, it will become apparent to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. A portable variable intensity signalling flashlight comprising a first incandescent lamp, said first incandescent lamp having a first and second electrical terminal, a first variable resistor, said first variable resistor having a first and second terminal, said first terminal of said first incandescent lamp electrically connected to said first terminal of said first variable resistor, a second incandescent lamp, said second incandescent lamp having a first and second terminal, said first terminal a second variable resistor, said second variable resistor having a first and second terminal of said second incandescent lamp connected to said first terminal of said second variable resistor, means for manually adjusting the resistance of said first and said second resistors a battery, said battery having a first and second terminal, said second terminal of said first incandescent lamp connected to said second terminal of said second incandescent lamp and to said first terminal of said battery, a slide switch, said slide switch having a first, second, third, fourth, fifth, sixth, seventh, eighth, ninth and tenth contact, each of said first, second, third, fourth and fifth contacts of said slide switch being located a fixed distance apart from adjacent contacts along line, each of said sixth, seventh, eighth, ninth and tenth contacts of said slide switch being located said fixed distance apart from adjacent contacts along a second line, said first line parallel to said second line, said first contact and said sixth contact located on a third line transverse to said first line, said second contact and said seventh contact located on a fourth line transverse to said first line, said third contact and said eighth contact located on a fifth line transverse to said first line, said fourth contact and said ninth contact located on a sixth line transverse to said first line, said fifth contact and said tenth contact on a seventh line transverse to said first line, a pair of contact arms, said pair of contact arms manually slidable along an eighth line, said eighth line parallel to said first line, each of said pair of contact arms spaced apart a distance equal to said fixed distance and extending normal to said eighth line, each of said pair of contact arms having a length sufficient to contact said contacts of said first and said second lines, respectively each of said pair of contact arms electrically insulated from one another, said second terminal of said battery electrically connected to said sixth and said ninth and said tenth contacts, said second terminal of said first variable resistor electrically connected to said first and said fifth contacts, said second terminal of said second variable resistor electrically connected to said fourth contact.

* * * * *